United States Patent [19]

Plugge et al.

[11] 4,163,599

[45] Aug. 7, 1979

[54] DETACHABLE HIGH VOLTAGE CONNECTION

[75] Inventors: Jay S. Plugge, Waukesha; Eugene S. Hammer, Greendale, both of Wis.

[73] Assignee: General Electric Company, Milwaukee, Wis.

[21] Appl. No.: 883,868

[22] Filed: Mar. 6, 1978

[51] Int. Cl.[2] ..... H01R 7/06

[52] U.S. Cl. ..... 339/115 C; 174/84 S; 339/89 R; 339/268 R

[58] Field of Search ..... 174/84 S, 88 S, 94 S; 339/89 R, 115 R, 115 C, 268 R, 268 S, 116 R, 116 C, 94 C

[56] References Cited

U.S. PATENT DOCUMENTS

| | | | |
|---|---|---|---|
| 1,771,805 | 7/1930 | Miller | 339/268 R |
| 2,581,655 | 1/1952 | Harden | 339/268 R X |
| 2,659,062 | 11/1953 | Tibbetts | 174/84 S X |

*Primary Examiner*—E. F. Desmond

*Attorney, Agent, or Firm*—Roger C. Turner

[57] ABSTRACT

A pair of electrical cables to be interconnected, each have an outer layer of insulation and a central conductor terminating in a cable end. A generally funnel shaped conductor is attached to the conductors of each cable end forming a concave terminal on each cable end. A spherical conductor is interposed between the funnel shaped conductors of the cable ends. The cable ends and the spherical conductor are compressively engaged to provide assured electrical contact through the cables and are enclosed within a tubular dielectric housing. The cable ends extend through apertures in threaded end plugs and into the tubular housing. The housing includes a dielectric grease to displace all air within the housing. A seal and tubular sleeve are interposed between the end plugs and the funnel shaped conductors of the cable ends so that threaded engagement of the end plugs provide axial compressive forces on the funnel shaped conductors and also seal the connection. The connection is readily detachable by the threaded disengagement of the end plugs.

10 Claims, 4 Drawing Figures

DETACHABLE HIGH VOLTAGE CONNECTION

BACKGROUND OF THE INVENTION

The present invention relates generally to electrical connections, and more particularly to an electrical connection for interconnecting high voltage cables.

In many high voltage apparatus it is necessary to make a connection of cables which conduct voltages in excess of 30,000 volts. A high voltage connection requires positive contact over a large continuous area in order to prevent high electrical stress and also requires isolation within a dielectric medium in order to prevent corona and voltage creep around the connection.

An example of such an electrical connection is in a cable between a power supply and an image tube of a diagnostic x-ray apparatus. The prior art connection consisted of a male type connector permanently attached to the image tube and a mating female type connector attached to the power supply. The male connector included a brass button soldered to a No. 14 gauge cable, with the solder connection and a portion of the insulated cable potted within a Lexan tube. The female connector included a spring loaded brass button soldered to the conductor of a similar No. 14 gauge cable, with the solder joint and a portion of the insulated cable potted within the rear section of a mating hollow Lexan tube. The male connector was received within the hollow tubular opening of the female connector and fixedly engaged. The electrical contact was dependent upon the spring tension of the spring-loaded brass button. The connector components were quite expensive to produce, and the spring-loaded connector was not durable and was subject to malfunctions after repeated assemblies. In addition, the connectors could not be repaired in the field because of their integral nature. A failure of the high voltage cable or the connector attached to the image tube during manufacturing tests or in the field required that the entire tube and cable assembly be sent back to the supplier for repair. Similarly, a failure of the high voltage cable or the connector attached to the power supply required that the entire power supply and cable assembly be sent back to the supplier for repair.

Other commercially produced high voltage connectors were available which did not require potting to the cables. However, these connectors were extremely bulky and would not fit within the available space of the apparatus.

Accordingly, one object of the present invention is to provide an effective connection for a high voltage cable.

Another object of the invention is to provide a cable connection which can be repeatedly disconnected and reconnected without deterioration of the quality or life of the connection.

Another object is to provide a cable connection which can be readily disconnected in the field and be readily repaired and reconnected.

Another object is to provide a cable connection having a very compact housing with reduced physical dimensions.

Still a further object of the present invention is to provide a connection having a large contact area within a highly dielectric medium to reduce dielectric stress and corona.

SUMMARY OF THE INVENTION

The invention is directed to a detachable high voltage connection for interconnecting a pair of electrical cables. The electrical cables each have an outer insulation and a central conductor terminating in a cable end. A generally funnel shaped conductor is attached to the conductors of each cable end forming a concave terminal on each cable end. A spherical conductor is interposed between the funnel shaped conductors of the cable ends, all of which are enclosed within a tubular dielectric housing. The cable ends and the spherical conductor are compressively engaged to provide assured electrical contact through the cables. The cable ends extend through apertures in threaded end plugs and into the tubular housing. The housing includes a dielectric grease to displace the air within the housing. A seal and tubular sleeve are interposed between the end plugs and the funnel shaped conductors of the cable ends so that threaded engagement of the end plugs provide axial compressive forces on the funnel shaped conductors and also seal the connection. The connection is readily detachable by the threaded disengagement of the end plugs.

BRIEF DESCRIPTION OF THE DRAWINGS

While the novel features of the invention are set forth with particularity in the appended claims, the invention will be better understood, along with other features thereof, from the following detailed description taken in conjunction with the drawings in which:

DESCRIPTION OF THE PREFERRED EMBODIMENT

Figure 1:
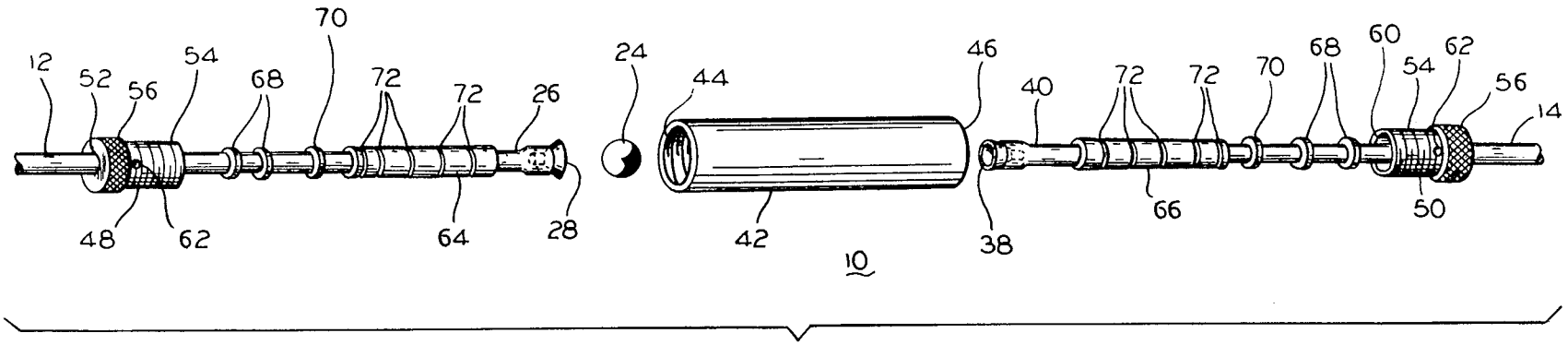
FIG. 1 is an exploded perspective view of the high voltage connection of this invention.

With reference to the accompanying drawings, there is shown the high voltage connection 10 for interconnecting cables 12 and 14 of an electrical apparatus. For exemplary purposes, cable 12 is permanently attached to and extended from a high voltage power supply (not shown), and cable 14 is permanently attached to and extended from an x-ray image tube (not shown) of a diagnostic x-ray apparatus. Cables 12 and 14 support approximately 30,000 volts during operation and conduct current through central conductors 16 and 18, and have soft durometer outer insulation 20 and 22. In this example, cables 12 and 14 are No. 14 gauge, high voltage cables having a strand wire conductor and having an insulation of approximately 0.25 inch diameter and rated at 30 KVDC. The high voltage power is conducted from cable 12 to cable 14 by way of a generally spherical conductor 24. Spherical conductor 24 is of a highly conductive material and in this example is a 0.375 inch diameter solid brass ball.

Figure 2:
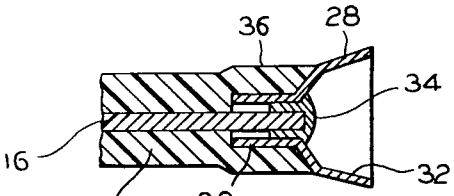
FIG. 2 is an enlarged, detailed sectional view of a generally funnel shaped conductor soldered to the cables shown in FIG. 1.

Referring particularly to FIG. 2, there is shown the conductor 16 of cable 12, terminating in a cable end 26. In order to make good contact between the conductor 16 and spherical conductor 24 at cable end 26, a generally funnel shaped conductor 28 is attached to conductor 16 forming a concave terminal on the cable end. A suitable brass funnel shaped terminal is available from Stimpson Company, Incorporated and known as "flange funnel eyelet—part number A879." Cable end 26 is cut to the desired length and the insulation 20 is not stripped from conductor 16. The barrel portion 30 of funnel shaped conductor 28 is inserted between the central conductor 16 and the outer insulation 20 until conductor 16 extends within the bowl area 32 of conductor 28, so that they may be soldered. Solder 34 is applied to bond conductor 28 to conductor 16, forming the concave terminal on cable end 26. The insertion of barrel portion 30 between the conductor 16 and insulation 20 produces an expanded insulation diameter 36 on the cable end which will be utilized later in the assembly.

A similar funnel shaped conductor 38 with inner bowl 39 is attached in conductive contact to central conductor 18, terminating in cable end 40 of cable 14. The funnel shaped conductors 28 and 38 provide an excellent termination of the cable ends 26 and 40 to capture spherical conductor 24 in compressive engagement to provide assured electrical contact through the cables. The inner bowls 32 and 39 of the funnel shaped conductors 28 and 38 are generally self-aligning around the spherical conductor, and can absorb a large variation in shape and pressure and still maintain electrical contact. The contact of funnel shaped conductors 28 and 38 with the surface of spherical conductor 24 is with a relatively large circular engagement having no single point contacts. It should also be noted that solder connection 34 of conductors 28 and 38 are within the internal envelope of the funnel shaped conductors and allow no single strand wires to protrude from the connection as a point of electrical stress.

As an alternative embodiment, the bowl portion of conductors 28 and 38 could be hollow, hemispherically shaped conductors precisely mating spherical conductor 24. This shape provides an even larger contact area between the cable ends and the spherical conductor.

Figure 3:
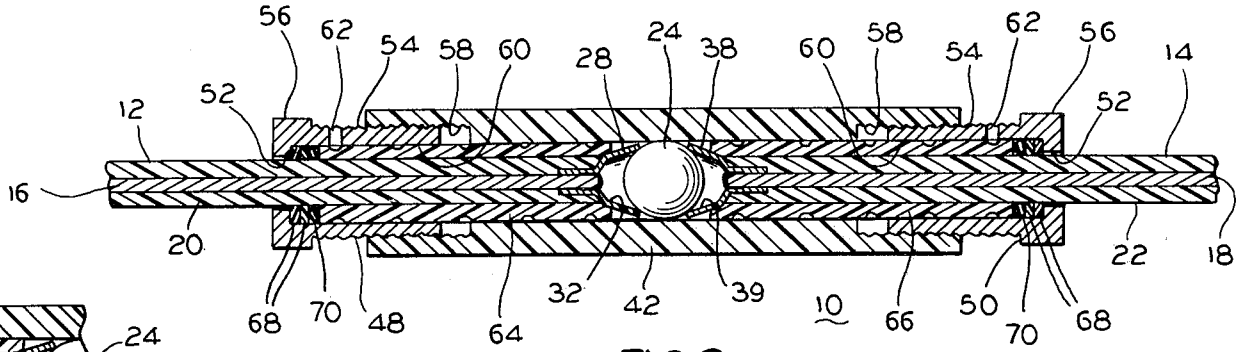
FIG. 3 is an enlarged longitudinal sectional view of the connection of FIG. 1, shown in the assembled configuration.

Referring particularly to FIGS. 1 and 3, there is shown the means for housing and insulating cable ends 26 and 40 in compressive engagement with spherical conductor 24 to provide assured electrical contact through the cables. A tubular housing 42 is provided to receive cable end 26 in one opening 44 and cable end 40 in the other opening 46, with spherical conductor 24 interposed between the cable ends. Tubular housing 42 is fabricated from a high dielectric material. In this preferred embodiment, tubular housing 42 is fabricated from Lexan material and has a wall thickness in excess of twice the rated breakdown thickness at 30 KVDC of the material. The inner diameter of tubular housing 42 is generally as small as possible to centrally align the spherical conductor 24 within the housing and to reduce the quantity of air within the interior of the housing.

Cables 12 and 14 are extended through concentric end plugs 48 and 50. End plugs 48 and 50 have a central aperture 52 with the diameter of the aperture slightly larger than the diameter of the cable insulation 20 and 22. End plug 48 is adapted to be received by opening 44 of tubular housing 42. In this embodiment, screw threads 54 and a knurled portion 56 are provided on the end plug for engaging mating screw threads 58 in opening 44 of tubular housing 42. End plug 50 is similarly adapted to engage opening 46 of tubular housing 42. The end plugs 48 and 50 also have internal counterbores 60 and vent holes 62 extending from the counterbore to the exterior of the plugs.

In order to provide compressive engagement of the funnel shaped conductors 28 and 38 on opposite sides of spherical conductor 24, tubular sleeves 64 and 66 are interposed between each of the end plugs 48 and 50 and funnel shaped conductors 28 and 38, respectively on cables 12 and 14. The tubular sleeves 64 and 66 are provided with an inner diameter to generally fit over the diameter of outer insulation 20 and 22 and have an outer diameter sized to generally fit within the inner diameter of the tubular housing 42. As end plugs 48 and 50 are advanced into engagement with tubular housing 42, the tubular sleeves 64 and 66 bottom out against the internal counterbore 60 of the end plugs and are forced inwardly toward the funnel shaped conductors 28 and 38. The sleeves 64 and 66 are sized lengthwise such that each is forced over at least some portion of the expanded insulation diameter 36 to thereby provide an air seal between the cable outer insulation and the tubular sleeve. Bearing washers 68, such as flat Teflon washers, are provided between the tubular sleeves 64 and 66 and the respective end plug 48 and 50 so that the rotation of the end plugs will not cause the tubular sleeve to rotate and thereby "wind-up" cables 12 and 14 within the connection. A seal 70, such as an o-ring, is interposed between the inner most washer 68 and the respective sleeve 64 and 66. The seals have inner diameters corresponding to the diameters of the cable insulation 20 and 22, and upon being compressed are adapted to seal the end plugs 48 and 50 around cables 12 and 14. In addition to sealing the exterior ends of end plugs 48 and 50, the compressed seals 70 exert a central axial spring force on sleeves 64 and 66 to further assure electrical contact of the connection. The compressed seal 70 is expanded tightly around cables 12 and 14 to also provide strain relief for the cables.

Figure 4:
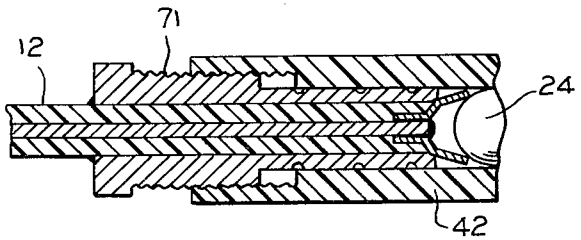
FIG. 4 is a sectional view showing one end of another embodiment of the connection.

As an alternative embodiment, the end plug and sleeve can be combined into a single component. The single component end plug 71 can be shown (see FIG. 4) generally as elements 48, 64, 68 and 70 all fused into an end plug having an extended interior portion. The single component end plug 71 requires an external seal and can result in "wind-up" of the cable as the end plug is rotated. However, this embodiment would be less expensive and suitable for some connection applications.

The components of the housing are closely interfit so that very little air space is available within the interior of the housing in the assembled configuration. In fact, an air vent path must be provided to allow any internal air to escape from the interior of the housing in order to be able to assemble the components. Helical grooves 72 are provided around tubular sleeves 64 and 66. The helical grooves 72 extend from the inner most point on the tubular sleeve to the outer most point and interconnect with vent holes 62 in end plugs 48 and 50. The helical groove 72 provides a very long path for any air to escape from the interior of the housing. It is well known that the presence of air around a high voltage conductor results in corona which can often oxidize the dielectric materials and provide a leakage path for the voltage and this will continue to creep until the connection breaks down. It is therefore necessary to remove all air from the interior of the housing and displace it with a high dielectric medium. A dielectric grease, such as a silicon grease - GE tradename "Insulgrease," is provided to displace the air within the tubular housing, and fill the helical grooves 72 and seal the vent holes 62.

To properly assemble the connection 10, approximately two inches of lead 14 is exposed between funnel shaped conductor 38 and sleeve 66 and the entire length is coated with a liberal amount of the dielectric grease. The outside diameter of sleeves 66 and the internal counterbore 60 of end plug 50 is also coated with the dielectric grease. End plug 50 is inserted into opening 46 of tubular housing 42 and tightened 4 or 5 turns. A liberal amount of dielectric grease is applied into end 44 of tubular housing 42 and then spherical ball 24 is inserted into the housing. A liberal amount of high dielectric grease is also applied to the components of the other side of the connection and end plug 48 is inserted into opening 44 of tubular housing 42 and tightened 4 or 5 turns. End plugs 48 and 50 are then tightened simultaneously until they are seated. As the end plugs are engaged within the tubular housing, the internal volume of the housing decreases and forces all of the internal air and any excessive grease along helical grooves 72 and out of vents 62. The end plug engagement also provides axial compressive forces on the funnel shaped conductors and the spherical conductor to thereby provide assured electrical contact through the cables. It is normal that grease will flow out of the vents 62 in the end plugs 48 and 50 during assembly.

Connection 10 provides an effective connection for interconnecting high voltage cables. The connection can be repeatedly disconnected and reconnected with no deterioration of the quality or life of the connection. The connection can be readily repaired in the field by trimming off the old cable end and replacing any damaged components, then installing a new funnel shaped conductor to the conductor of the cable by a simple solder operation and then reinstalling the cable into the tubular housing. The displacement of any air within the interior of the housing by dielectric grease provides a connection enclosed within a highly dielectric medium and reduces any stress or corona within the connection.

While specific embodiments of the present invention have been illustrated and described herein, it is realized that modifications and changes will occur to those skilled in the art. It is therefore to be understood that the appended claims are intended to cover all such modifications and changes as fall within the true spirit and scope of the invention.

What is claimed is:

1. A high voltage electrical cable connection for interconnecting a pair of electrical cables, each having an outer insulation layer and a central stranded conductor terminating in a cable end; said connection comprising:

a. first and second generally funnel shaped conductors in conductive contact enclosing the stranded conductor and extending from each of said cable ends;

b. a spherical conductor interposed between said funnel shaped conductors; and c. means for housing and insulating said cable ends, said funnel shaped conductors, and said spherical conductor in compressive engagement within a dielectric medium to provide electrical contact through the cables.

2. The connection as recited in claim 1 wherein said housing means also includes means for placing said funnel shaped conductors in compressive engagement on opposite sides of said spherical conductor.

3. The connection as recited in claim 1 wherein said housing means further comprises means for sealing said cable ends and said spherical conductor within the dielectric medium.

4. The connection as recited in claim 1 wherein said housing means comprises:

a. a tubular housing having two open ends for receiving one said cable end in one end and the other said cable end in the other end; and b. two end plugs each having a central aperture therein, with the diameter of the aperture slightly larger than the diameter of the cable insulation;

c. one said cable end extending through the aperture in one said end plug and the other said cable end extending through the aperture in the other said end plug;

d. said tubular housing adapted to engagingly receive said end plugs in the respective end openings of said tubular housing.

5. The connection as recited in claim 4 wherein said end plugs have screw threads and said tubular housing has corresponding screw threads to engage said plugs.

6. The connection as recited in claim 5 which further comprises:

a. tubular sleeves having an inner diameter to generally fit over the diameter of the outer insulation of the cable and having an outer diameter to generally fit within the inner diameter of said tubular housing;

b. said tubular sleeves interposed between each said end plug and each said cable end.

7. The connection as recited in claim 6 wherein each said cable end has said outer insulation having an expanded diameter portion and said tubular sleeves fit over said expanded diameter portions in an air sealing manner.

8. The connection as recited in claim 6 which further comprises:

a. bearing washers interposed between said end plugs and said tubular sleeves; and b. compressible o-ring seals interposed between said end plug and said washers;

c. said o-ring seals having inner diameters corresponding to the diameters of the cables and upon being compressed adapted to seal the apertures of said end plugs around the cables.

9. The connection as recited in claim 6 which further comprises:

a. a high dielectric grease within said housing;

b. said grease having a volume exceeding the internal free space of the assembled connection;

c. air and grease passage means in said housing wherein the engagement of said end plugs into said housing reduces the internal volume of said housing and thereby forces the internal air and any excessive grease from the housing and provides axial compressive forces on said funnel shaped conductors and said spherical conductor to thereby provide said assured electrical contact through the cables.

10. The connection as recited in claim 6 wherein said tubular housing, said end plugs and said tubular sleeves are formed from high dielectric materials.

* * * * *